US008651394B2

(12) United States Patent
Heïnrich et al.

(10) Patent No.: US 8,651,394 B2
(45) Date of Patent: Feb. 18, 2014

(54) LAVAL NOZZLE FOR THERMAL SPRAYING AND KINETIC SPRAYING

(75) Inventors: Peter Heïnrich, Germering (DE); Heinrich Kreye, Hamburg (DE); Thorsten Stoltenhoff, Wentorf (DE)

(73) Assignee: Sulzer Metco AG, Wohlen (CH)

( * ) Notice: Subject to any disclaimer, the term of this patent is extended or adjusted under 35 U.S.C. 154(b) by 2112 days.

(21) Appl. No.: 10/835,264

(22) Filed: Apr. 30, 2004

(65) Prior Publication Data

US 2005/0001075 A1 Jan. 6, 2005

(30) Foreign Application Priority Data

Apr. 30, 2003 (DE) ..... 103 19 481

(51) Int. Cl.
*B05B 7/00* (2006.01)

(52) U.S. Cl.
USPC ..... 239/1; 239/79; 239/592; 239/595; 239/601

(58) Field of Classification Search
USPC ..... 239/79, 80, 592, 595, 601, 1, 589
See application file for complete search history.

(56) References Cited

U.S. PATENT DOCUMENTS 4,300,723 A * 11/1981 Prasthofer ..... 239/499
4,875,810 A 10/1989 Chiba et al.
4,916,273 A * 4/1990 Browning ..... 219/121.47
5,047,612 A * 9/1991 Savkar et al. ..... 219/121.47
5,302,414 A * 4/1994 Alkhimov et al. ..... 427/192
5,399,713 A 3/1995 Knuebel et al.
5,573,682 A * 11/1996 Beason et al. ..... 219/121.5
6,419,593 B1 * 7/2002 Heinrich et al. ..... 473/324

FOREIGN PATENT DOCUMENTS

| | | |
|---|---|---|
| BE | 522059 | 10/1955 |
| EP | 0532134 | 3/1993 |
| JP | 62095127 | 5/1987 |

OTHER PUBLICATIONS

Patent Abstracts of Japan, Sep. 29, 1987, vol. 0113, No. 00, pp. C-449 & JP 62095127.
Dylthuizeri et al., "Gas Dynamic Principles of Cold Spray"; Journal of Thermal Spray Technology, vol. 7(2) Jun. 1998, pp. 205-212.
Stoitenhoff et al., "Cold Spraying—State of the Art and Applicability": pp. 386-374.
Stoltenhoff et al., "An Analysis of the Cold Spray Process and It's Coating"; Journal of Thermal Spray Technology, vol. 11(4) Dec. 2002, pp. 542-550.
Steltenhoff et al., "Cold Spraying from Thermal Spraying to High Kinetic Energy Spraying"; Dec. 2000, pp. 1-10.
Zucrow et al. "Gas Dynamics"; Volume II, pp. 232-233.
Manuel Frey "PhD Thesis" Re: design of rocket riozzies; pp. 21-24.

* cited by examiner

*Primary Examiner* — Jason Boeckmann
(74) *Attorney, Agent, or Firm* — Millen, White, Zelano & Branigan, P.C.

(57) ABSTRACT

The invention relates to a Laval nozzle for thermal spraying and kinetic spraying, especially for cold gas spraying, with a convergent section and a divergent section. To achieve a better degree of application effect, at least a portion of the divergent section, according to the invention, has a bell-shaped contour.

27 Claims, 2 Drawing Sheets

LAVAL NOZZLE FOR THERMAL SPRAYING AND KINETIC SPRAYING

The invention relates to a Laval nozzle for thermal spraying and kinetic spraying, especially for cold gas spraying, with a convergent section and with a divergent section. Such nozzles are used in cold gas spraying and are employed for the production of coatings or shaped parts. To this end, powdery spray particles are injected by means of a powder tube into a gas jet, for which a compressed and heated gas is depressurized via the Laval nozzle. The spray particles are accelerated to high speeds above the speed of sound when the gas jet depressurizes in the divergent portion of the Laval nozzle. The spray particles then strike the substrate and bond to an extremely dense layer because of their high kinetic energy. In addition to the cold gas spraying, the nozzle is also suitable for the other processes of thermal spraying, such as flame spraying or high-speed flame spraying with inert or reactive spray components.

It is known to apply coatings by means of thermal spraying to a wide variety of materials. Known processes for this purpose are, for example, flame spraying, arc spraying, plasma spraying or high-speed flame spraying. More recently, a process was developed, the so-called cold gas spraying, in which the spray particles are accelerated to high speeds in a "cold" gas jet. The spray particles are added as powder, whereby the powder usually at least partially comprises particles measuring 1-50 μm. After the spray particles are injected into the gas jet, the gas is depressurized in a nozzle, whereby gas and particles are accelerated to speeds above the speed of sound. Upon impact at high speed, the particles in the "cold" gas jet form a dense and tightly-adhering layer, whereby plastic deformation and local release of heat that results therefrom provide for cohesion and adhesion of the spraying layer to the work piece. Heating the gas jet increases the flow rate of the gas and thus also the particle speed. In addition, it heats the particles and thus promotes their plastic deformation during impact. The gas temperature can be up to 800° C., but significantly below the melting temperature of the coating material, so that a melting of the particles in the gas jet does not occur. Oxidation and phase conversions of the coating material can thus be largely avoided. The percentage of sprayed particles adhering to the work piece is termed herein as "the application effect".

Such a process and a device for cold gas spraying are described in detail in the literature, for example in European Patent EP 0 484 533 B1. As the nozzle, a Laval nozzle is used. Laval nozzles consist of an upstream convergent section and a downstream divergent section in the direction of flow. Laval nozzles are characterized by the contour and the length of the divergent section and in addition by the ratio of the outlet cross-section to the smallest cross-section (=expansion ratio). The smallest cross-section of the Laval nozzles is at the nozzle neck. As process gases, nitrogen, helium, argon, air or mixtures thereof are used. In most cases, nitrogen is used, but higher particle speeds are achieved with helium or helium-nitrogen mixtures.

The commonly used nozzle described in EP 0 484 533 B1, has the shape of a double cone with a total length of approximately 100 mm. It has an expansion ratio of about 9; in addition a variant with an expansion ratio of 6 is also used. The length of the convergent section is about ⅓ and that of the divergent section is ⅔ of the nozzle length. The nozzle neck has a diameter of about 2.7 mm.

Currently, devices for cold gas spraying are designed for pressures of about 1 MPa up to a maximum pressure of 3.5 MPa and gas temperatures of up to about 800° C. The heated gas is depressurized together with the spray particles in the Laval nozzle. While the pressure in the Laval nozzle drops, the gas speed increases to values of up to 3000 m/s and the particle speed to values of up to 2000 m/s.

Particular devices for cold gas spraying are described in DE 101 26 100 A1. The nozzle shown there has—if the injector nozzle for the powder is ignored—a pure cone shape in the divergent area of the embodiments of FIGS. 1 and 2*c*. The embodiment of FIG. 2*a* has a cylindrical shape, and that of FIG. 2*b* has an outward curvature. "Outward curvature" means that the line of the boundary in FIG. 2*b* at the bottom exhibits a curvature to the right, i.e., toward the outside, in the direction of flow of the gas. The upper boundary line exhibits a curvature to the left, i.e., also toward the outside. The cross-sectional surface areas of the nozzle increase further in going outward, i.e., more quickly than in a corresponding cone.

In a completely different technological field, namely that of rockets, Laval nozzles are also used as thrust nozzles. The appropriate nozzles have a significantly larger expansion ratio. Here, the point is to accelerate the gas (or the combustion product) as much as possible by the shortest possible path. A problem of the rocket nozzle in this case is the thrust reduction by jet divergence in the nozzle outlet. This is described in the textbook "Gas Dynamics, Vol. 1," pages 232 and 233. For this reason, thrust-optimized rocket nozzles have a bell-shaped contour, which allows the gas to leave the nozzle in as parallel a flow as possible (=parallel-jet nozzle). The flow behavior of any expelled particles contained in the combustion products of the rockets is relatively unimportant for the optimization of the nozzle. In contradistinction during thermal spraying and especially during cold gas spraying, the content of particles in the free jet behind the nozzle has a primary importance.

One object of the invention is to provide a nozzle for thermal and kinetic spraying to the extent that the application effect is increased and in this case the tendency of the particles toward deposition on the nozzle wall is reduced. Another object is to provide a spraying method employing this nozzle.

Upon further study of the specification and appended claims, other objects and advantages of the invention will become apparent.

According to one aspect of the invention there is provided a method of spraying particles onto a workpieceemploying nozzle in which either the entire divergent section or at least a portion of the divergent section has a bell-shaped contour. Such a nozzle, which has comparable dimensions to the above-described EP-484,533 standard nozzle relative to nozzle length, length ratio of convergent to divergent sections, expansion ratio, diameter of the nozzle neck, etc., but according to the invention has a bell-shaped contour of the divergent nozzle section, shows a significantly better application behavior. In a comparison test between a standard nozzle and a nozzle with a bell shape, an increase of the degree of application effect of 50 to 55% to 60 to 65% was produced when using the same copper powder with a particle size of 5 to 25 μm and otherwise identical process parameters relative to gas pressure, gas temperature, gas flow, powder delivery rates, spray interval, etc. By itself—almost undetectable to the eye—the small modification of the divergent portion from a cone shape to a bell shape, i.e., a first disproportionately large and then relatively small widening or bulge in comparison to a cone shape, produces this clear increase of the application effect. The degree of application effect is defined as the percent of the amount of powder that adheres to the work piece compared to the amount of powder that is sprayed over the same length of time per unit of surface area.

Bell shape means in other words, that starting from the tapering, i.e., starting from the neck of the nozzle, a convex-concave curve plot is carried out, whereby the flow cross-section always is larger or at least remains the same, but is never smaller. It is also possible to imagine the curve plot in such a way that: if a small toy car, whose front points to the right, is positioned at point (20/1.6) of the upper line of the figure, it would travel straight ahead in the first moment and then make a left-hand turn until approximately at point (22/1.65). Then comes the turning point, starting from which the motor vehicle would make a right-hand turn and then travel along a right-hand curve until the end of the line at about (150/3.2), whereby, however, the steering lock angle of the steering system is increasingly smaller. The first section from 20 to 22 is convex; the larger section from 22 to 150 is concave.

It is advantageous if the entire divergent section is configured in the shape of a bell. It is also sufficient, however, if only a portion of the divergent section has a bell shape and the remainder is configured differently, for example as a cone or as a cylinder. The beginning of the divergent section preferably has a bell shape. The latter then extends over one third or half the length of the divergent section. Then, the nozzle can turn into another shape, whereby it is advantageous if the nozzle does not have any unchangeability or "bends" in its plot. An abrupt transition from the bell shape to a cone or from the cone to a cylinder should be avoided, since abrupt transitions disrupt the uniformity of the gas flow. Accordingly, the nozzle is free from abrupt transitions, which would disrupt the uniformity of the gas flow.

In one embodiment, the bell-shaped contour is configured such that a parallel-jet nozzle is present, i.e., the jet leaves the nozzle in a parallel manner, without expanding. This second variant of the invention with the same diameter in the nozzle neck, but a longer divergent section, whose bell-shaped contour was designed such that a virtually parallel gas flow is achieved, produces a degree of application effect of 75 to 80% with otherwise identical process parameters.

Stated in another way, the method aspect of the invention is directed to a coating method comprising spraying a jet of gas carrying particulate material by thermal and kinetic spraying through an outlet of a Laval nozzle onto a work piece to form a coating thereon, said Laval nozzle having a converging section and a diverging section, the improvement comprising conducting the method through a Laval nozzle wherein the divergent section has a sufficient extent of a bell shape so as to provide an increase in the percentage of particles that affix to the work piece compared to the use of a cone-shaped divergent section, all other parameters being equal.

In a more specific embodiment of the invention, the total length of the nozzle is between 60 and 300 mm, with nozzles having total lengths of 100 to 200 mm being preferred.

It is also preferred that the cross-section in the nozzle neck is 3 to 25 $mm^2$, especially preferably 5 to 10 $mm^2$.

Advantageous results have been produced in nozzles whose expansion ratio is between 1 and 25.

Nozzles in which the outlet Mach number is between 1 and 5, especially advantageously between 2.5 and 4, are also advantageous.

The particle speed depends on the type and the state variable of the gas (pressure, temperature), the particle size and the physical density of the particle material (article by T. Stoltenhoff et al. from the conference proceedings of the $5^{th}$ HVOF Colloquium, Nov. 16 and Nov. 17, 2000 in Erding, formula on the bottom of page 31). It is therefore possible to adapt the nozzle contour especially to the process gases, nitrogen, air and helium as well as the spraying material.

In one embodiment of the invention, a powder tube is provided in the nozzle that is used in the supply of the spray particles and ends in the divergent section of the nozzle. Such powder tubes and nozzle geometries are shown in DE 101 26 100 A1, to the disclosure of whose entire contents reference is made here. The divergent section of the nozzle, however, always has at least one bell-shaped section.

In another variant, in which the contour was matched even better to nitrogen as a process gas and copper as a spray material, a degree of application effect of over 80% was reached. The optimization was then carried out by variation of the nozzle contour and calculation of the particle speeds that can then be achieved. The significant increase of the degree of application effect by the invention can be attributed to the fact that more or even larger powder particles are sprayed at higher than the minimum speed necessary for the adhesion of the particles.

The better acceleration of the particles by the new nozzle also allows the use of a larger powder. Thus, powders with particle sizes of between 5 and 106 μm can now be used instead of the previously used powders having a particle size of 5 to 25 μm, whereby the known powders can of course be used in addition. Larger powders are significantly more economical. Another advantage of the larger powders consists in that when spraying with these powders, deposits result on the nozzle wall only at higher gas temperatures. A higher gas temperature produces a higher flow rate of the gas and a lower gas consumption, resulting in savings in powders and gas in the production of layers.

BRIEF DESCRIPTION OF DRAWING

The attached drawing illustrates an internal contour of one embodiment of the nozzle of the invention.

DETAILED DESCRIPTION

Figure 1:
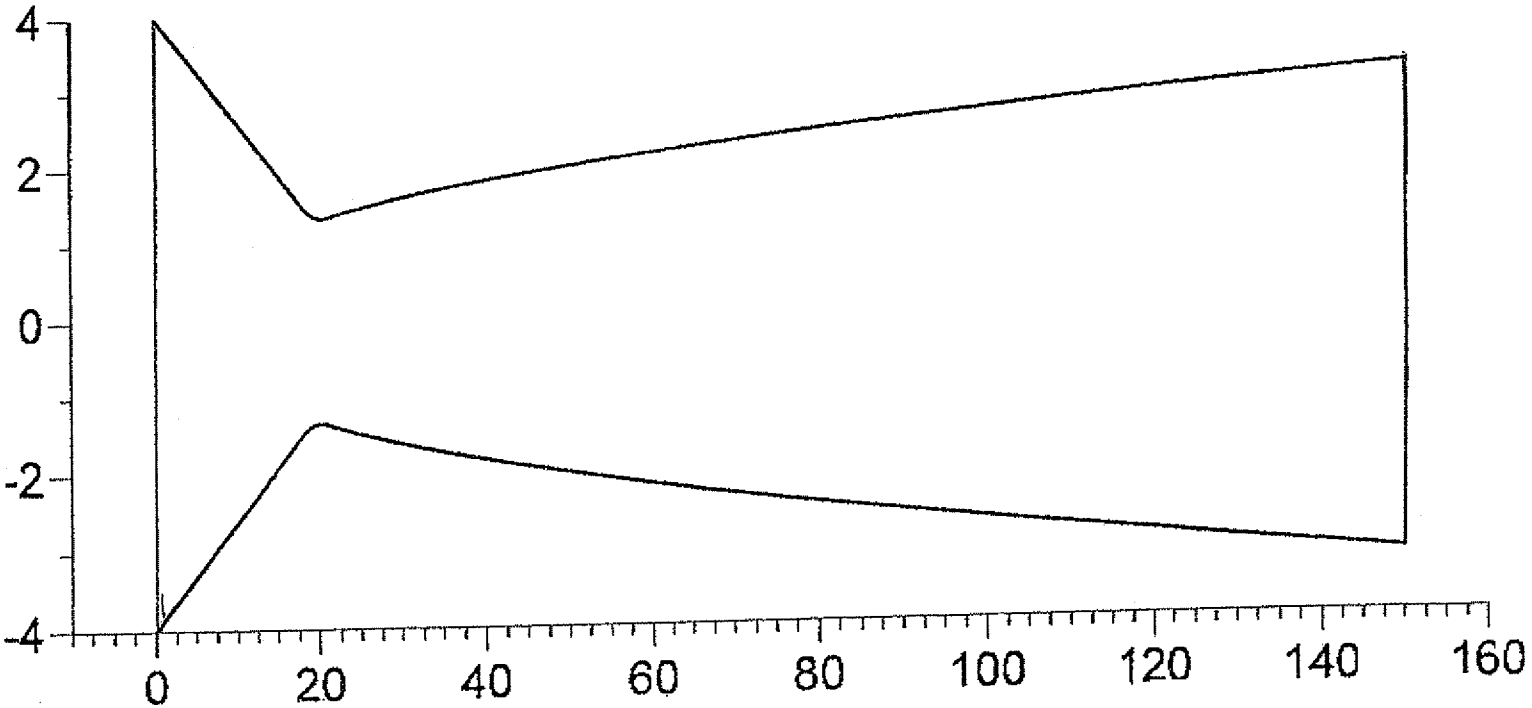

One embodiment of the invention is shown based on the single figure.

The figure shows the inside contour of a Laval nozzle according to the invention, whereby the gas flows from the left to the right. It can be seen that the length of the convergent section is significantly smaller than the length of the divergent section, e.g., the ratio of the length of the converging section to the divergent section is on the order of about 2 to 13, and that the neck section has convex walls, and is shorter, lengthwise, than the convergent section, and that the divergent section as a whole has a bell shape, in contrast to the nozzle of FIG. 2b of DE 101 26 100 A1. Conversely, the convergent section in this embodiment of the invention is configured conically over its entire length. In the divergent section, a continuous reduction of the slope is seen when the upper boundary line is followed from left to right, and a continuous increase of the slope when the lower boundary line is followed. By operating with this bell shape, the jet leaves the nozzle in a substantially parallel manner, and disadvantageous effects such as compression strokes in the nozzle outlet or pressure nodes in the free jet are significantly reduced. The measurements are purely by way of example and do not limit the scope of protection of the invention.

By "virtually parallel" is meant, in general that a divergence from the core flow of less than 10° is acceptable.

In the method aspect of the invention the gas employed is generally at a temperature of 0-800° C., with 200-600° C. being preferred. The particles sprayed include metals, ceramics not limited to metallic, ceramics, and metal—ceramic composites. The work piece which is coated is generally ceramic, metallic or even polymeric.

As a preferred embodiment of the method, a heat sink is fabricated wherein copper is sprayed on an aluminum work piece so that the aluminum can be welded.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 10319481.9, filed Apr. 30, 2003 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

BRIEF DESCRIPTION OF DRAWINGS

Figure 2:
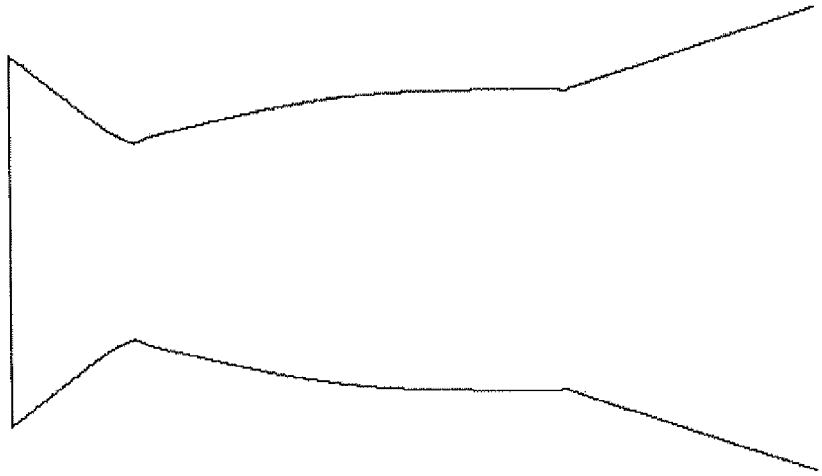
Figure 3:
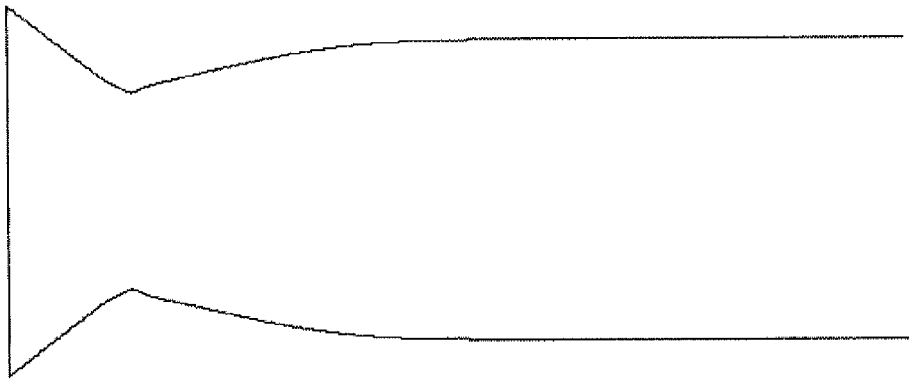

FIG. 1 illustrates an embodiment of the invention,

FIG. 2 illustrates another embodiment of the invention (the figure is not to scale), and FIG. 3 illustrates a further embodiment of the invention (the figure is not to scale).

The invention claimed is:

1. A coating method comprising spraying a jet of gas carrying particulate material by cold gas spraying or by high speed flame spraying through an outlet of a Laval nozzle onto a work piece to form a coating thereon, said Laval nozzle comprising a converging section and a diverging section, at a gas temperature of not more than 800° C. and below the melting temperature of the particulate material and through a Laval nozzle that is devoid of abrupt transitions, which would disrupt the uniformity of the gas flow, and wherein the divergent section has a sufficient extent of continuously curving concave walls to provide an increase in the percentage of particles that affix to the work piece compared to the use of a cone-shaped divergent section, and so as to provide a jet at the outlet having a velocity of a Mach number between 2.5 and 5.

2. A method according to claim 1, comprising spraying a jet through the nozzle said jet being substantially parallel to said nozzle.

3. A method according to claim 1, wherein the entire length of the nozzle is between 60 and 300 mm.

4. A method according to claim 1, said nozzle having a nozzle neck cross-section of 3-25 $mm^2$.

5. A method according to claim 1, said nozzle having a nozzle neck and a nozzle outlet, said nozzle having an expansion ratio, the ratio between the cross section of the nozzle neck and the cross-section of the nozzle outlet of between 1 and 25.

6. A method according to claim 1, wherein the gas comprises at least one of nitrogen, air and helium.

7. A method according to claim 1, wherein the temperature of the gas is in the range of 200° to 600° C.

8. A method according to claim 1, wherein the size of the particulate material is 5 to 106 μm.

9. A method according to claim 1, wherein the size of the particulate material is 5 to 25 μm.

10. A method according to claim 1, wherein the size of the particulate material is 10 to 38 μm.

11. A method according to claim 1, wherein the size of the particulate material is 30 to 70 μm.

12. A method according to claim 1, wherein the entire length of the nozzle is between 100 and 200 mm.

13. A method according to claim 1, said nozzle having a nozzle neck cross-section of 5-10 $mm^2$.

14. A method according to claim 1, said nozzle having a nozzle neck and a nozzle outlet, wherein the jet has a velocity at the outlet of a Mach number between 2.5 and 4.

15. A method according to claim 3, said nozzle having a nozzle neck and a nozzle outlet, said nozzle having an expansion ratio, the ratio between the cross section of the nozzle neck and the cross-section of the nozzle outlet of between 1 and 25.

16. A method according to claim 3, which is a method where the gas is sprayed by high speed flame spraying.

17. A method according to claim 1, wherein the particulate material consists essentially of particulate copper and the work piece consists essentially of aluminum.

18. A method according to claim 3, which is a method where the gas is sprayed by cold gas spraying.

19. A method according to claim 1 wherein the converging section is configured conically over the entire length thereof.

20. A method according to claim 1 wherein the ratio of the length of the converging section to the divergent section is on the order of about 2 to 13.

21. A method according to claim 1 wherein the particles pass through the converging section, a neck section and a diverging section wherein the neck section has convex walls, and is shorter, lengthwise, than the convergent section, and the convergent section is shorter, lengthwise, than the divergent section.

22. A method according to claim 1, wherein the divergent section has a sufficient extent of continuously curving concave walls to provide for an about 50 to 65 percentage increase of particles that affix to the work piece compared to the use of a cone-shaped divergent section.

23. A method according to claim 1, wherein the divergent section has a sufficient extent of continuously curving concave walls to provide for an about 75 to 80 percentage increase of particles that affix to the work piece compared to the use of a cone-shaped divergent section.

24. A coating method comprising spraying a jet of gas carrying particulate material by cold gas spraying or by high speed flame spraying through an outlet of a Laval nozzle onto a work piece to form a coating thereon, said Laval nozzle comprising a converging section and a diverging section, at a gas temperature of not more than 800° C. and below the melting temperature of the particulate material and through a Laval nozzle that is devoid of abrupt transitions, which would disrupt the uniformity of the gas flow, and wherein the entire divergent section has continuously curving concave walls, and so as to provide a jet at the outlet having a velocity of a Mach number between 2.5 and 5.

25. A coating method comprising spraying a jet of gas carrying particulate material by cold gas spraying or by high speed flame spraying through an outlet of a Laval nozzle onto a work piece to form a coating thereon, said Laval nozzle comprising a converging section and a diverging section, at a gas temperature of not more than 800° C. and below the melting temperature of the particulate material and through a Laval nozzle that is devoid of abrupt transitions, which would disrupt the uniformity of the gas flow, and wherein the divergent section has through a part thereof, which is less than through its entire length, continuously curving concave walls, and so as to provide a jet at the outlet having a velocity of a Mach number between 2.5 and 5.

26. A method according to claim 25, wherein about one third or one half of the length of the divergent section has continuously curving concave walls, and a remaining part of the length of the divergent section has a cone or cylinder shape.

27. A coating method comprising spraying a jet of gas carrying particulate material by cold gas spraying or by high speed flame spraying through an outlet of a Laval nozzle onto a work piece to form a coating thereon, said Laval nozzle comprising a converging section, a neck section, and a diverging section, at a gas temperature of not more than 800° C. and below the melting temperature of the particulate material and through a Laval nozzle that is devoid of abrupt transitions, which would disrupt the uniformity of the gas flow, wherein the neck section has a length and convex walls, and wherein the divergent section has through a part thereof or through its entire length continuously curving concave walls, and so as to provide a jet at the outlet having a velocity of a Mach number between 2.5 and 5.

* * * * *